United States Patent [19]

Bouchard

[11] 3,957,269

[45] May 18, 1976

[54] TACTICAL BASEBALL GAME

[76] Inventor: Reginald Bouchard, P.O. Box 342, Florence, Mass. 01060

[22] Filed: Mar. 21, 1975

[21] Appl. No.: 560,987

[52] U.S. Cl. ..... 273/93 C; 273/93 R
[51] Int. Cl.[2] ..... A63F 3/00
[58] Field of Search ..... 273/93, 108

[56] References Cited

UNITED STATES PATENTS

| | | | |
|---|---|---|---|
| 812,048 | 2/1906 | Kirby | 273/93 R |
| 1,435,688 | 11/1922 | Bell | 273/93 R |
| 1,533,487 | 4/1925 | White | 273/108 |
| 1,557,284 | 10/1925 | Horowitz | 273/93 C |
| 2,283,578 | 5/1942 | Rogers | 273/93 C |
| 2,347,506 | 4/1944 | Riehle | 273/93 R |
| 2,490,737 | 12/1949 | Muthart | 273/93 C |
| 2,742,290 | 4/1956 | Fasana | 273/93 C |
| 2,812,181 | 11/1957 | Richman | 273/93 C |
| 3,368,813 | 2/1968 | McGraw | 273/93 R |

*Primary Examiner*—Richard C. Pinkham
*Assistant Examiner*—Harry G. Strappello
*Attorney, Agent, or Firm*—Leonard S. Michelman

[57] ABSTRACT

The baseball game herein described uses two sets of conventional playing cards of the type having four suits, each suit having 13 cards, 2 through Ace. There is a playing board which has the baseball field with 11 positions. There are six defensive and five offensive positions. There is also the at bat position and the homerun position as well as the outfield and infield positions. There are automatic out positions in the outfield and a double play position at short stop. There are automatic hit positions on the bases. There is a homerun position on the scoreboard and at the at bat position. The pitcher and catcher are also automatic out positions. The defensive or home team places its playing cards at random in the positions for the cards on the playboard at all outfield positions, double play, pitcher, and catcher. The offensive team deals cards to the batter, all the bases and the homerun position on the scoreboard. The defensive team also deals the offensive team nine cards from its deck. The offensive team deals the defensive team nine cards from its deck. The game is played according to the rules which are described in the detailed specification. After the offensive team makes three outs, the cards are cleared from the playboard, reshuffled, and the other team is at bat. The same procedure takes place except for the other team is at bat. There are located on the scoreboard means for keeping a record of the runs for the home team, visiting team and the number of innings played. There are also chips for keeping aware of the number of outs. There is also available a pinch hitting dial which has a predetermined layout of the various suits, spades, hearts, diamonds and clubs with corresponding numbers so that the people playing the game can use a pinch hitter at the appropriate time.

4 Claims, 7 Drawing Figures

HOME
VISITOR
INNING
SUPER LEAGUE
score board
5
HOME RUN
5
HOME RUN
3
2
7
cf ao
lf ao
rf ao
2 ah
dp ao
3 ah
1 ah
pitcher out ao
at bat HR
play box
play box
catcher ao
1
2
3
4
5
6
7
8
9
10
11
12
13
14
15
19
20
21
22
25
26
32
34
35

TACTICAL BASEBALL GAME

This invention is concerned with a baseball game, having a new and novel design of a baseball board and the playing of the game with two decks of conventional playing cards.

It is an object of the within invention to provide a new and novel playing board that can be used with conventional playing cards of four suits, and 52 cards, thirteen in each suit.

It is an additional object of the within invention to provide a game that can create pleasure and entertainment.

It is yet an additional object of the within invention to provide a baseball game that can be played indoors, and still maintain the competition of a real outdoor baseball game.

It is a further object that the within invention provide a baseball game that can be played by two people, or teams of more than one person on each side.

It is yet a further object of the within invention to provide a baseball game that may be played with playing cards that more than two people can play so that a team can be organized and a team can play against another team using the same board with all of the people in the playing of the game at the same time.

It is yet an additional object of the within invention to provide a baseball game that can be played with playing cards on a novel board, which teams of more than one on a side can play, and, in which batting and fielding averages can be maintained as well as earned run averages, and the like, so that a regular baseball game is simulated, with the use of playing cards and the playing board.

These and many other objects are obtained by the use of the within invention, reference being made to the following detailed description in which.

DESCRIPTION OF COMPONENTS PARTS

Figure 1:
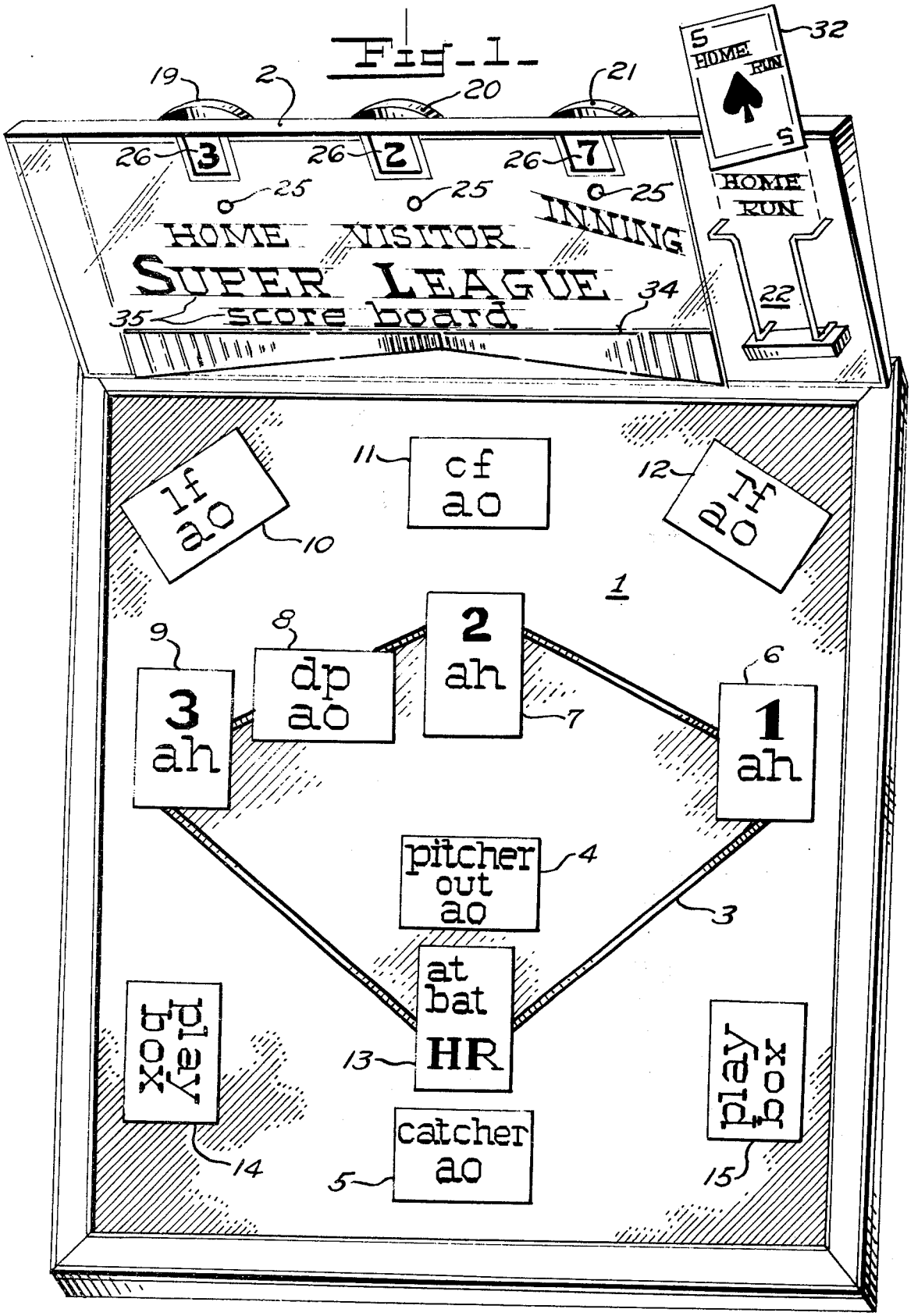
FIG. 1 is a top elevational view in perspective of the board used for the purpose of playing the game.
Figure 2:
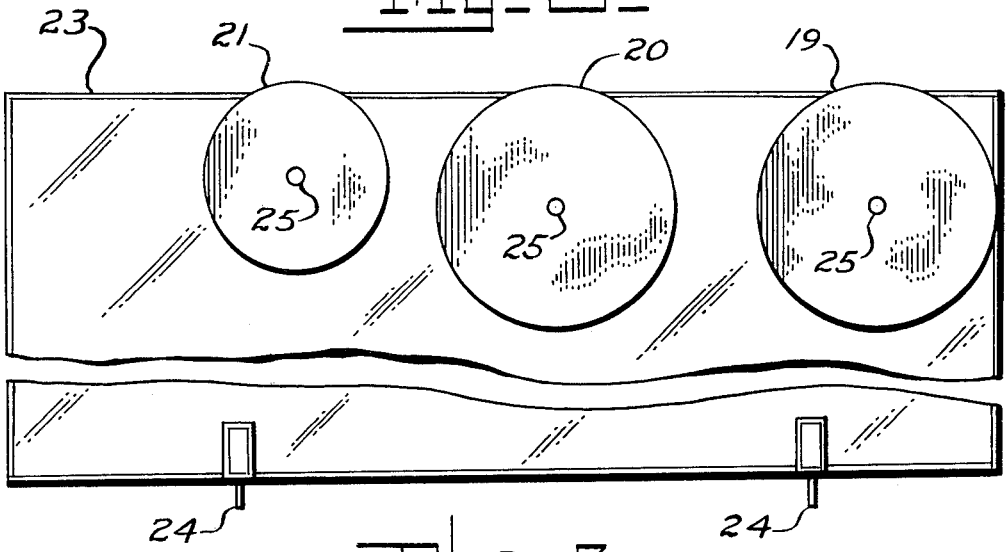
FIG. 2 is a view looking at the rear side of the scoreboard of FIG. 1 in a top elevational position.

The baseball field board 1 is made of a plastic covering over a cork material. This could be made also of a firm paper board with a proper finish on top. It is necessary that the material of the board be made of a permanent type so that the game can be reused. The top of the board 1 is shown in FIG. 1 looking down on the board. At the end of the board when it is set down flat upon the surface upon which it is to be played, there are two openings not shown in which the scoreboard back 23 of FIG. 2 is inserted. The scoreboard 2 has at the bottom edge thereof pins 24. The pins 24 fit into the openings not shown, at edge of the board 1 next to the outfield area near the top of FIG. 1.

Looking at the scoreboard 2, there are three separate dials 19, 20 and 21, which appear above the edge of the scoreboard 2. The dial 19 has numerals to indicate the numbers of runs scored by the home team. The word "home" is written underneath the window in which the indicia of the dial 19 appears. This is indicated in the drawing of FIG. 1 at 26. There is also a plurality of numbers on the dials 20, and 21. Dials 19, 20 and 21 are mounted by a pin 25 and revolve thereabout.

The dial 20 is for the keeping of a record of the number of runs scored by the visiting team. There are numbers on the face of that dial which appear through the window opening 26. Similarly dial 21 is used to record the number of the inning. In the within embodiment there are numbers 1–10. If the game is tied at the end of ten innings, the number 1 can be used for the 11th inning, 2 for the 12th inning and so on.

Also appearing on the scoreboard 2 is the printed matter 35 stating that it is the "scoreboard." On the right hand side of the scoreboard 2 is a card holder 22. This is for the home run card. It will be explained later that during the course of the play of the game a card 32 which can be any card in the deck of 52 playing card, and, which in the embodiment shown is the 5 of spades, is inserted in the card holder 22, mounted on the scoreboard 2. This is the card which indicates a home run. The card holder 22 compromises a pair of wire vertical members about the length of a playing card. At the bottom thereof there is a support block for holding the card which is set between the wire vertical members.

Also mounted on the scoreboard 2 is a fence 34 to give to the game the simulation when a ball is hit over the fence, it is a home run. The fence is part of the printed matter on the scoreboard 2.

Reference is made to the back 23 of the scoreboard shown in FIG. 2. The pins 25 are shown in the center of the discs 19, 20 and 21 in their respective order. It is to be noted that the discs 19 and 20 are larger than the disc 21 because there are more numbers on these discs for the runs. As stated there are only 10 numbers 1–10 on disc 21 for the innings.

The mounting pins 24 can be seen in FIG. 2 more clearly, extending from the lower edge of the rear side 23 of the scoreboard 2 adopted for engagement in the board 1. The discs 19, 20 and 21 rotate on the pins 25 which are mounted within the scoreboard 2, so as to enable them to rotate.

In order to move the discs 19, 20 and 21, it is only necessary to place a finger on the top edge thereof as seen in FIG. 1 and rotate them either clockwise or counter clockwise to locate the proper number which the player of the game desires to put into position.

The playing board which is shown in FIG. 1 has a baseball diamond printed thereon. HOme plate has an area for a playing card at 13. The words "at bat H R" appear in this area location. The diamond is shaped similar to a real baseball diamond and has the base paths located between the various bases. The first base area is located at 6 and has printed therein the "1" standing for first base and "AH" underneath it, being the abbreviation for automatic hit. Second base is located at area 7 opposite the catcher and between first and third base at 2 having the printing "2" and AH, also an abbreviation for automatic hit.

Third base has printed thereupon beneath where the card is to be placed the numeral 3, and AH also being the abbreviation for automatic hit.

While there is no short-stop shown, the position of the short-stop between second and third base has a station indicated by the numeral 8. Printed thereupon is "DP" standing for double play, and also printed beneath it, "AO" for automatic out.

As will be explained hereinafter, if nobody is on the bases, it will be impossible to have a double play. Therefore the short-stop position will be an automatic out.

Behind the home plate at 5 is the position of the catcher. This is also an AO, automatic out, position. It will be observed that because of the size of the board in the within embodiment, both at the short-stop position 8 and the catchers position 5, it is necessary to place the cards horizontally, rather than vertically.

On each side of the diamond are the dug-outs or play boxes respectively, 14 and 15. These are the areas where cards the opposing teams are placed, to bat, and defend. This will be explained in accordance with the rules hereinafter. A pitcher is located at 4 opposite the catcher 5 and in front of the batter, between second base. The card placed in the pitchers box 4, if it complies with the rules, by the batter will be an automatic out, AO.

The outfield is comprised of three outfielders as in a typical baseball game. Right field 12 is an automatic out, AO. Centerfield at the position 11, is an automatic out, AO as is leftfield at 10.

Figure 3:
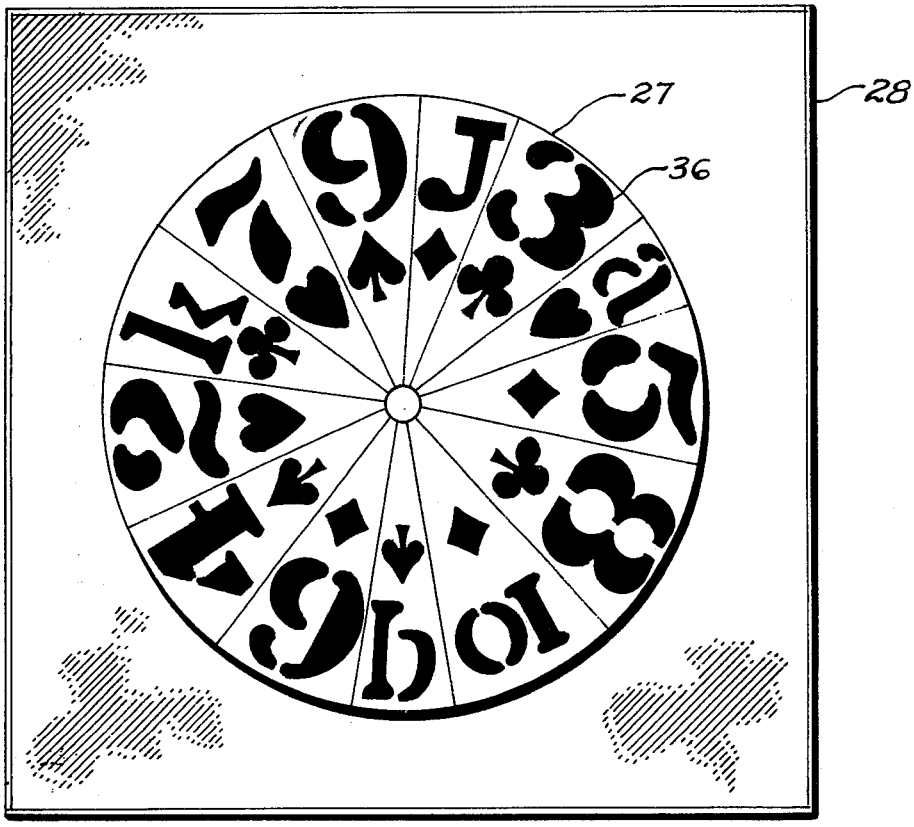
FIG. 3 is a top plan view of the pinch hitters dial, without the needle being in place.

Reference is now made to the pinch hitter dial 28, which is shown in the view of FIG. 3.

The pinch hitting dial 27 has the numbers or letters of the playing cards with the suits, diamonds, hearts, spades or clubs. There are 13 segments on the dial 27. For example, in one segment at 36, there is a 3 with a club underneath it. Then the pointer 29 is mounted in the opening in the center of the pinch hitting dial 27 which is mounted on the board 28, and when the pointer stops at a number 36 (which could be any number) and in this intance it is the 3 of clubs on the pinch hitting dial 27. If as the rules of the game will explain, there is a club which is the 3 of clubs sitting on an automatic hit base, then the pinch hitter will have obtained an automatic hit. Similarly, if the pointer stops at a number like, for example, the 9 of spades, and there is no 9 of spades on an automatic hit location, then the pinch hitter will be out, in all probability depending upon what card is played by the defensive player, which will be hereinafter explained in accordance with the rules of the game. The purpose of the pinch hitting dial 27 is to give to the game the added element to enable to have the use of a pinch hitter, when the cards that the offensive team haS do not contain any automatic hit cards in the deck. This will be explained hereinafter.

The needle 29 has a pin 30 which fits into the opening in the middle of the board 28 of the pinch hitter dial 27. The needle can be removed from the dial when the game is unpacked. It is with the spirit and scope of the invention that the pointer 29 can be permanently mounted by a rivot within the opening in the board 28 so as to be rotatable therein.

Figure 5:
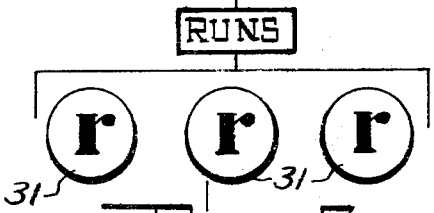
FIG. 5 is a top plan view of the circular discs having the letter r appearing thereupon which are used to simulate base runners.
Figure 6:
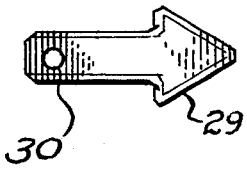
FIG. 6 is a top plan view of the needle which is inserted in the pinch hitters dial (shown in FIG. 3).
Figure 7:
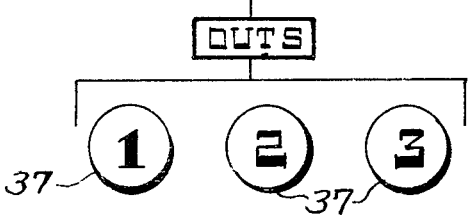
FIG. 7 is a top plan view of the discs to indicate the number of outs.

The use of the discs 31 for offensive team runners on the bases is to give to the game the impression that there is actually a baseball game being played. It would be in the scope of the invention to have small toy miniature men running on the bases. These discs 31 are placed on top of the cards which are on top of the bases while the game is being played. For the purpose of this embodiment, they are the discs 31 shown in FIG. 5.

Similarly, there are 3 discs, 1, 2 and 3 to show the number that are face down until the first out is made and then they are turned up. They are placed at the bottom of the board. It is within the scope of the invention to locate on the scoreboard a smaller disc similar to 19, 20, and 21 to keep a record of the outs 1, 2, and 3, instead of using the discs 37. However, in the embodiment shown, the preferred method is to use the discs 37 for the keeping of a record of the outs 1, 2, and 3.

The playing cards as previously stated are conventional playing cards, having 52 cards of 4 suits, spades, hearts, diamonds and clubs, from the Ace through the 2. Two decks of playing cards are required.

We are now ready to describe the rules and play of the game.

RULES AND PLAY OF THE GAME

Let us assume that two people instead of a team of people desire to play this game. First they cut the cards to see who is up at bat first, that is to determine who will be the visiting team and who will be the home team and up last. Each takes a deck of cards and each draws a card. The one who obtains the highest card will be up first, and will be the visiting team.

Figure 4:
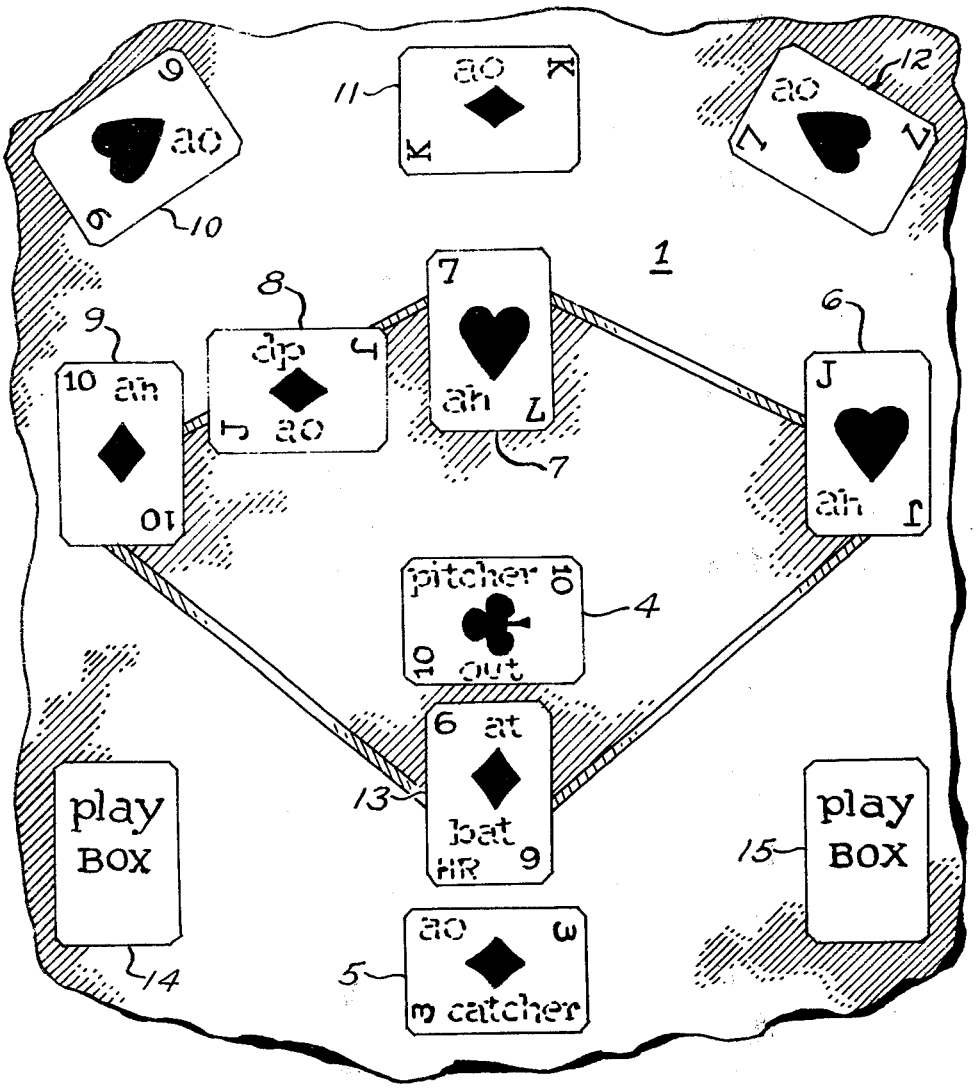
FIG. 4 is a diagramatic view of the baseball board of figure one, without the scoreboard, indicating an example of how the cards are placed over the printed matter of the board, so as to explain how the board is used to play the baseball game.

It is necessary to use two separate decks of cards and preferably cards that do not have the same design on the back so that they will not be confused. The at bat or visiting team shuffles his cards and deals from the top of the deck to all the bases. The defensive team places a card as shown in FIG. 4 in the position 5 where it says catcher; in this instance the 3 of Diamonds is at position 5. He places the card in the pitchers box at position 4; in this instance, the 10 of Clubs; he places a card at the short-stop position 8, which in this instance is the Jack of Diamonds. He now places cards in the three outfield positions, leftfield, centerfield and rightfield at positions 10, 11 and 12 respectively. In this instance, he has dealt the 9 of Hearts, the King of Diamonds and the 7 of Hearts. It is to be noted that wherever these cards that the home team has placed are all automatic outs positions. It is necessary to know why they are automatic outs positions as the game is played.

While we have described the defense or home team as dealing out the cards first, it is not essential that they do this first. The visiting team can also deal out the cards first or at the same time. This is not crucial.

The visiting team or the team up first having shuffled his cards, now deals out cards to the positions at the batters box (at home plate) 13 and in this instance it is the 6 of Diamonds. He also places a card on first base at position 6, which in this instance is the Jack of Hearts. Similarly he places a card on second base, which in this instance, is the 7 of Hearts. He also places a card at third base position 9, which in this instance is the 10 of Diamonds.

It is not shown in the view of FIG. 4 the card in the home run Bracket 22. This is shown in the view of FIG. 1 indicated by the card 32 which happens to be in this instance the 5 of Spades, which is also dealt by the visiting team.

All of the cards have been dealt by both teams and we are ready to play baseball. The visiting team deals 9 cards from the top of his deck and gives them to the home team. The home team also deals nine cards from the top of the deck and gives them to the visiting team. Each player can look at the cards, hold them, like they were playing bridge or gin rummy and look at all of their cards. They do not show their cards to the opponent. After each looks at his cards, he looks at the view of FIG. 4 (the field with the cards thereon) to see what cards are on base. As in the embodiment shown, in the explanation to FIG. 4, there is on base the following cards, in the batters box the 6 of Diamonds, at first the Jack of Hearts, at second the 7 of Hearts and at third the 10 of Diamonds. Each player has cards among the nine cards he is holding in his hand for one of those cards that are on base, or the home run card, particularly, which is the 5 of Spades. Let us assume that the player has among his nine cards the 10 of Diamonds. He immediately puts the 10 of Diamonds down on the play box 14, face up. Now it is the turn of the home team to play. He must follow suit. The strategy is to find a diamond among his nine cards, which would be an automatic out. He looks at the board where the automatic out positions are. He observes that the catcher position 5 has the 3 of Diamonds, the short-stop position 8 has the Jack of Diamonds, the centerfield position has the King of Diamonds. These are all automatic outs. If he has any one of these cards he places it in play box 15 and the batter is now out. If he does not have any one of these three cards, he must follow suit with a Diamond. He plays as the Diamond card any one of the Diamonds he has in his hand as long as it is not the King of Diamonds which is in centerfield 11, the Jack of Diamonds which is at short-stop 8 or the 3 of Diamonds in the catchers box 5. The visiting team now has a base runner. He takes one of the runners which is the disc 31 and he places it at third base 9, on top of card, the 10 of Diamonds. He now turns the card in his play box 14, the 10 of Diamonds over face down, and similarly the defensive of home team turns his Diamond card over face down. If the defensive team did not have a Diamond in his hand, to put in the player box 15, then he must find a card in a suit that is another automatic out. There is in the automatic out positions at left field the 9 of Hearts and at rightfield the 7 of Hearts, and 10 of Clubs in the pitchers box at 4. He must use either the club or a heart from his 9 card holding which is now placed in the play box 15. This does not effect the situation of the visiting team since he now has a base runner at third base as previously described. There are no outs, and the next batter is due up for the visiting team. The next card is played by the visiting team. If he doesn't have any further base runners in his holding among his remaining cards the stategy is to play any high card. If he does not have another card that is an automatic hit, his best chance is to play the suit of the furthest base. The suit of the furthest base without a runner which in this instance is second base, which happens to be in the Heart suit. Since the batter does not have the 7 of Hearts, he plays the highest heart out of his hand that he can find. Let us assume that he has in his hand the King of Hearts. He places the King of Hearts face up in the play box 14. The defense now has to play a heart. The only higher Heart that will make this an out is the Ace of Hearts which is higher than the King of Hearts. If the defense or the home team does not have the Ace of Hearts or does not have the King of Hearts, in which instance it would also be an out since it is a matching card, the batter of the visiting team will have a two base hit. However, the defense or home team must follow a Heart and put any Heart in his box

15. If he has the Ace of Hearts and let us assume he does, the batter is out. The Ace of Hearts is turned face down in the play box at 15. The King of Hearts is turned face down in the box 14 of the visiting team. Two cards have now been used by each of the teams. They hold in their respective hands 7 remaining cards. There is now one out. The one out disc 37 is placed at the bottom of the board face up near the home team station, underneath play box 14. The third batter of the inning comes up to bat. Among the remaining cards of the home team is the Jack of Hearts. Let us assume the visiting team did not use the Jack of Hearts, originally because he wanted to put as many men on base as he could before he batted in any runs. However, with one out he does not wish to hit into a double play, and, therefore, he wants to bring in his run from third base to be sure he goes ahead, since it is in the early innings.

One can now observe that strategy plays a very important part in the play of this game, which makes it so exciting and interesting. The visiting team places the Jack of Hearts into the play box 14. It is now up to the defensive home team to find a card that will make this an automatic out. Once again the defensive team looks around for all of his Hearts. He does not have the 7 of Hearts nor the 9 of Hearts, which are automatic outs at positions 10 and 12. Among his seven remaining cards, he does not have any other Hearts or other cards that would be automatic outs. He now looks for the Jack of Diamonds to attempt to have a double play. He does not have this card. If he had the Jack of Diamonds, he would have a double play and it would be the equivalent of for example, a line drive hit by the batter which was caught and the man on third base would be off the bag and doubled up as an out and it would clear the bases without any runs. However, since the defensive team does not have the Jack of Diamonds, nor does he have the King of Diamonds, nor does he have the Jack of Hearts, the 7 of Hearts, nor the 9 of Hearts, he now must use his own strategy. The home team has been holding back. He does not want to have two runners on base because it may be that his opponent holds the 5 of Spades, which is the home run card. He now uses the 10 of Clubs which will be an automatic out and wipe out the automatic hit of the Jack of Hearts. The 10 of Clubs is like a trump card or a wild card to be used at all times against all automatic hits and especially against home run cards. The wild card in accordance with the rules of the game is any card that is face up in the pitchers box. This is in position that designates a trump or a wild card. It is used to prevent an automatic hit at any time as a defense or a block against the strategy of the batting team. The defensive team desires, therefore, in this instance to use the 10 of Clubs which is among the original nine cards with which he started. Now there is no runner on first base. The Jack of Hearts is turned over face down at position 14 and the 10 of Clubs is turned over at position 15. We now have two outs and the disc 37 with number 2 is placed in position face up, underneath the box at 14 which is the batting teams box. The situation is now that the visiting team has a runner at third base, the 10 of Diamonds. There are two outs and each team has six cards left. Let us assume that the visiting team does not have among his six cards, another automatic hit or a home run card. He desires to bring in the runner at third base because he only has one out left. The visiting team finds among his remaining six cards the Queen of Diamonds. He now uses the Queen of Diamonds and places it face up in the play box 14. The reason he uses the Queen of Diamonds is he has a Diamond on third base and this will give him another triple if the home team does not have the Queen of Diamonds, King or Diamonds, or Ace of Diamonds in his cards. The home team now looks to see what he has to stop this run and the only Diamonds he has left among his six cards is the 10 of Diamonds. He must follow suit. He, therefore, plays the 10 of Diamonds and the runner on third base comes in for a score. The disc 20 for the visiting teams on the scoreboard 2 at position 26 above the words visitors is pushed into position that now reads 1. The scoreboard for the visiting team has a numeral 2 in the window at 26 but there are various numbers there. Another runner is put on third base and the runner that was there is taken off. This is done with discs 31. The players are now down to five cards. There are 2 outs. The visitors have a runner on third base. The visiting team has no more Diamonds and no more Hearts. He has the three of Spades in his hand. Because this suit is not on the base, the most that he could hope for with a three of spades would be a single. This would still score the runner from third base. Things do not look good about bringing in this runner because it is most likely that the home team will have a Spade higher than or equal to the 3 of Spades. The visiting team looks at the rest of his cards to see if he has a higher card than the 3 of Spades. He finds that he has the Jack of Clubs which is not on the bases. However, the Jack of Clubs is the same suit as the automatic out in the pitchers box. Since the 10 of Clubs has already been played, it will not block the play of the Jack of Clubs. Therefore, since the Jack of Clubs is higher than the 3 of Spades, it is much better strategy in playing out the cards to use the Jack of Clubs instead of the 3 of Spades. More than likely, if the 3 of Spades were used, than the defensive team would have a Spade larger than the 3 of Spades or equal to it. However, the percentage of the Clubs that the defensive team would have above the Jack of Clubs would be limited to only four cards, the Jack of Clubs, the Queen of Clubs, the King of Clubs or the Ace of Clubs; therefore, it would be better to use the Jack of Clubs, to keep the inning going and try to bring in the runner from third base. So the Jack of Clubs is, therefore, played by the offensive team and put down face up on play box 14. Now the defense looks at his remaining cards and finds that he does not have a Club higher than the Jack of Clubs, but he has the 9 of Clubs. He is forced to follow suit so he must play the 9 of Clubs. Now we have a runner on first base and we take one of the runner discs, 31, and place it on a position at first base which is position 6 above the Jack of Spades which happens to be there and we take the runner off the 10 of Diamonds. We now push the scoreboard above the word "visitors" and rotate the disc 20 to the position so that the indicia numeral 2 will appear through the window, and the visiting team now has two runs. There are still two outs. There are now remaining four cards. The only other card that looks like it might be a single that is held by the visiting team is the 3 of Spades. He, therefore, cannot play any of the other remaining cards in his hand as they will be regular outs, so he plays the 3 of Spades. However, the defensive team has the 5 of Spades. He plays this and there are now three outs. All of the cards are now picked up and put back in their respective decks. They are reshuffled and the last half of the first inning shall start. The batters will now be played from the cards at play box 15 and the home team will be up and the visiting team will become the defensive team. The same routine as outlined previously commences.

There are many other points of strategy that develop in the play of this game. The trump or wild card which is the pitcher box card will stop a homerun or even a card higher than that wild card in that particular suit. For example, as shown in the view of FIG. 4, there is the 10 of Clubs in the pitchers box at 4. There is the 5 of Spades for a homerun card in the area at 22 on the scoreboard. Let us assume that the batting team has the 5 of Spades and places it face up in his play box 14 or 15. It is now necessary to stop the homerun or the batting team will have homerun. Therefore, the defensive team if it has any Club greater than the 10 of Clubs, even if it does not have the 10 of Clubs will use the Club to stop the homerun.

If the defense does not have a Club, then there is no way to stop the homerun even with a higher Spade, as there is a way to stop the base hit or the automatic hit. This is the exception to the defense in the rules.

However, let us assume that the defense has the King of Clubs and the offense places down on the play box the 5 of Spades. If the defense now pulls the King of Clubs and puts it in its play box, since Clubs is the trump suit and since it is a higher trump than the trump in the pitchers box, (the 10 of Clubs) it stops the homerun and there is an out. Any card from the 10 of Clubs up through the Ace of Clubs would stop the homerun as the trump card. However, this applies to the homerun only, not as to the base hits. No Spade, whether it be a matching 5 of Spades or higher one will stop the homerun. Only the trump card or higher card in the suit in the pitchers box can stop the homerun. This is the only time that the player does not have to follow suit. He may use the trump card either when a homerun is hit or any other hit is made.

In addition to the home run card which is inserted in 22, there is also another home run card which is dealt by the offensive team which is at the bat card located at 13. In the view of FIG. 4, the 6 of Diamonds is a home run card. If any of the 9 cards dealt by the defensive team that are held by the offensive team happens to be the 9 of Diamonds shown in the example of the play of cards in FIG. 4, then this is a home run card. It can be used at the appropriate time by the batter. In the example explained, there was no 6 of Diamonds dealt. Had there been, the offensive team could have used it to bring in the runners. It would have been in the discretion of the offensive player to make the decision to use the card at the appropriate time. The point to be made here is that there are 2 home run cards, the one located at 22 and the one located at 13. This home run at 13 can be prevented in a similar mode as was explained in the prevention of the home run against the card located at 22, in the example shown with the 5 of Spades earlier explained in this specification.

I claim:

1. A game for playing baseball comprising two independent decks of conventional playing cards, a horizontal board having appearing thereupon a baseball diamond, with the following stations: at bat, first, second, third, short stop, left field, right field, center field, a play box for the offensive team, a play box for the defensive team, a home run position, said board including means for keeping a record of the runs for each team and a record of the innings, said at bat station being a home run position, said first, second and third bases being automatic hit positions, said left field, center field, right field and short stop stations being automatic out positions, a vertical scoreboard, said scoreboard having a fastening means for connecting to said horizontal board at right angles thereto, said scoreboard containing means for varying the indicia for the runs of each of the teams so as to keep a record thereof, means for varying the indicia for the innings to keep a record thereof, means for supporting a playing card from one of the decks which is a "home run card", and a spinner mounted on a surface having a plurality of segments thereon with the indicia of the various playing cards with the number, letter, and the suit of a card, said spinner assembly as described being used for pinch hitting.

2. A game as described in claim 1 where there are boxes for each team on the horizontal board, said play boxes being located on opposite sides of home plate and being used for the play of each deck of cards as the game progresses.

3. A game as described in claim 2 wherein there are circular discs adapted to be placed on the bases on the diamond to simulate the base runners.

4. A game as described in claim 3 wherein there are discs with indicia thereupon to indicate the number of outs as the game progresses.

* * * * *